US009931833B2

(12) United States Patent
Collins et al.

(10) Patent No.: US 9,931,833 B2
(45) Date of Patent: Apr. 3, 2018

(54) ALIGNMENT MODULE USED IN PRINTING

(71) Applicant: HEWLETT-PACKARD DEVELOPMENT COMPANY, L.P., Houston, TX (US)

(72) Inventors: David C Collins, Philomath, OR (US); Matthew J Gelhaus, Albany, OR (US); Carlos Millan-Lorman, Corvallis, OR (US); Bruce A Stephens, Corvallis, OR (US)

(73) Assignee: Hewlett Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/501,527

(22) PCT Filed: Aug. 15, 2014

(86) PCT No.: PCT/US2014/051342

§ 371 (c)(1),
(2) Date: Feb. 3, 2017

(87) PCT Pub. No.: WO2016/025003

PCT Pub. Date: Feb. 18, 2016

(65) Prior Publication Data

US 2017/0232731 A1 Aug. 17, 2017

(51) Int. Cl.

| | |
|---|---|
| ***B41J 2/045*** | (2006.01) |
| ***B41J 11/00*** | (2006.01) |
| ***B41J 29/393*** | (2006.01) |
| ***B41J 11/46*** | (2006.01) |
| ***B41J 29/42*** | (2006.01) |
| ***B41J 2/21*** | (2006.01) |

(52) U.S. Cl.

CPC ..... *B41J 2/04505* (2013.01); *B41J 2/04586* (2013.01); *B41J 2/2135* (2013.01); *B41J 11/008* (2013.01); *B41J 11/46* (2013.01); *B41J 29/393* (2013.01); *B41J 29/42* (2013.01)

(58) Field of Classification Search

CPC .. B41J 2/04505; B41J 2/04586; B41J 2/2135; B41J 11/008; B41J 11/46; B41J 29/393; B41J 29/42

See application file for complete search history.

(56) References Cited

U.S. PATENT DOCUMENTS

| | | | |
|---|---|---|---|
| 5,289,208 | A | 2/1994 | Haselby |
| 5,815,172 | A | 9/1998 | Moh |

(Continued)

OTHER PUBLICATIONS

Sutanto, E. et al.; "A Multimaterial Electrohydrodynamic Jet (E-jet) Printing System"; Mar. 15, 2012; http://rogers.matse.illionis.edu/files/2012/jmmmultiejet.pdf.

*Primary Examiner* — Anh T. N. Vo
(74) *Attorney, Agent, or Firm* — HP Inc. Patent Department

(57) ABSTRACT

A printing system includes an identification module to identify a number of the encoder pulses generated by an encoder at a rate corresponding to a speed of a media during a time interval. The printing system also includes an alignment module to at least one of change the number of encoder pulses or scale the encoder pulses generated by the encoder based on an amount of variation between the number of encoder pulses detected and the number of encoder pulses to maintain the number of encoder pulses constant.

15 Claims, 6 Drawing Sheets

(56) References Cited

U.S. PATENT DOCUMENTS

| | | | | |
|---|---|---|---|---|
| 6,068,362 | A * | 5/2000 | Dunand | B41J 3/4078 347/104 |
| 6,290,319 | B1 | 9/2001 | Boleda et al. | |
| 6,650,864 | B2 * | 11/2003 | Miyamoto et al. | B41J 3/60 399/301 |
| 7,126,107 | B2 | 10/2006 | Ahne et al. | |
| 7,364,251 | B2 * | 4/2008 | Arakawa | B41J 11/46 271/265.01 |
| 7,530,657 | B2 | 5/2009 | Thiessen et al. | |
| 8,300,242 | B2 | 10/2012 | Suzuki | |
| 2003/0156496 | A1 | 8/2003 | Tunnicliffe-Wilson | |
| 2005/0007407 | A1 | 1/2005 | Jauert | |
| 2005/0270360 | A1 | 12/2005 | Reisinger | |
| 2011/0074860 | A1 | 3/2011 | Saettel et al. | |

* cited by examiner

ALIGNMENT MODULE USED IN PRINTING

BACKGROUND

Printing systems including web press printing systems include a plurality of printheads to print on a media. In the printing system, the media may travel along a media path through a print zone. The respective printheads may selectively print on the media in the print zone.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
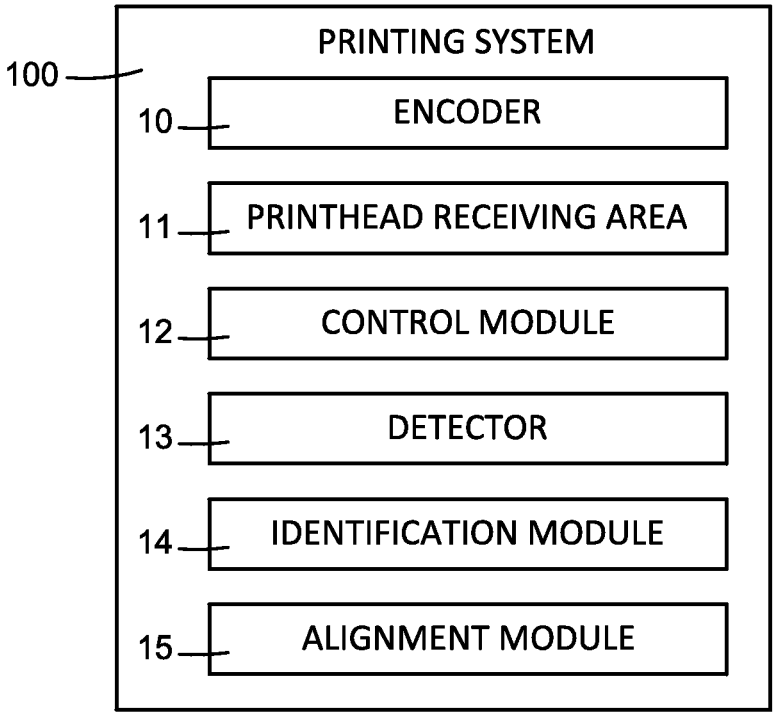
FIG. 1 is a block diagram illustrating a printing system according to an example.

In the following detailed description, reference is made to the accompanying drawings which form a part hereof, and in which is detected by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Printing systems including web press printing systems include a plurality of printheads to print on a moving media, an encoder to generate encoder pulses at a at a rate corresponding to a speed of a media, and a print zone. The printheads may be stationary and spaced apart from each other by a predetermined distance. In some examples, the printheads may be inkjet printheads. The media may travel along a media path through the print zone. The number of encoder pulses are intended to correspond to a respective position of the media (e.g., media portion) with respect to each one of the printheads. Respective printheads may selectively print on the media in the print zone based on image data and a generation of a respective number of encoder pulses generated by the encoder. At times, however, an alignment of the printheads with respect to each other and/or the media may be off due to pen position, media characteristics, paper moisture content, temperature variation, encoder variation, and the like. Such misalignment may be pronounced with respect to high-speed web presses including a large print zone. Thus, image degradation including print alignment artifacts may occur.

In examples, a printing system includes an encoder, a printhead receiving area, a control module, a detector, an identification module, and an alignment module. The printhead receiving area receives a plurality of printheads. The encoder generates encoder pulses at a rate corresponding to a speed of a media. The encoder pulses generated by the encoder are intended to correspond to a respective position of the media along a media path with respect to the each one of the printheads. In some examples, at least one printhead may print an alignment mark on the media. The control module selectively controls the respective printheads to print an image on the media based on a number of encoder pulses generated by the encoder. The detector detects the alignment mark on the media in the print zone.

The identification module identifies a number of the encoder pulses generated by the encoder during a time interval from the printing of the alignment mark until the detecting of the alignment mark. The alignment module at least one of changes the number of encoder pulses or scales the encoder pulses generated by the encoder based on an amount of variation between the number of encoder pulses detected and the number of encoder pulses to maintain the number of encoder pulses constant. Thus, the alignment module may correct misalignment based on rapid alignment feedback. That is, the alignment module may automatically compensate for alignment variation due to static and dynamic conditions throughout a print run. Accordingly, image degradation may be reduced.

FIG. 1 is a block diagram illustrating a printing system according to an example. Referring to FIG. 1, in some examples, a printing system 100 includes an encoder 10, a printhead receiving area 11, a control module 12, a detector 13, an identification module 14, and an alignment module 15. The printhead receiving area 11 receives a plurality of printheads. The encoder 10 generates encoder pulses at a rate corresponding to a speed of a media. The encoder pulses are intended to correspond to a respective position of the media along a media path with respect to the each one of the printheads. In some examples, at least one printhead may print an alignment mark on the media. The control module 12 selectively controls the respective printheads to print an image on the media based on a number of encoder pulses generated by the encoder 10.

Referring to FIG. 1, the detector 13 detects the alignment mark on the media in a print zone. The print zone may include a region between and adjacent to the respective printhead and a media path to receive the media to be printed on. The identification module 14 identifies a number of the encoder pulses generated by the encoder 10 during a time interval from the printing of the alignment mark until the detecting of the alignment mark. The alignment module 14 at least one of changes the number of encoder pulses or scales the encoder pulses generated by the encoder 10 based on an amount of variation between the number of encoder pulses detected and the number of encoder pulses to maintain the number of encoder pulses constant.

In some examples, the encoder 10, the control module 12, the detector 13, the identification module 14, and/or the alignment module 15 may be implemented in hardware, software including firmware, or combinations thereof. The firmware, for example, may be stored in memory and executed by a suitable instruction-execution system. If implemented in hardware, as in an alternative example, the encoder 10, the control module 12, the detector 13, the identification module 14, and/or the alignment module 15 may be implemented with a combination of technologies (for example, discrete-logic circuits, application-specific integrated circuits (ASICs), programmable-gate arrays (PGAs), field-programmable gate arrays (FPGAs)), and/or other technologies. In other examples, the encoder 10, the control module 12, the detector 13, the identification module 14, and/or the alignment module 15 may be implemented in a combination of software and data executed and stored under the control of a computing device.

Figure 2:
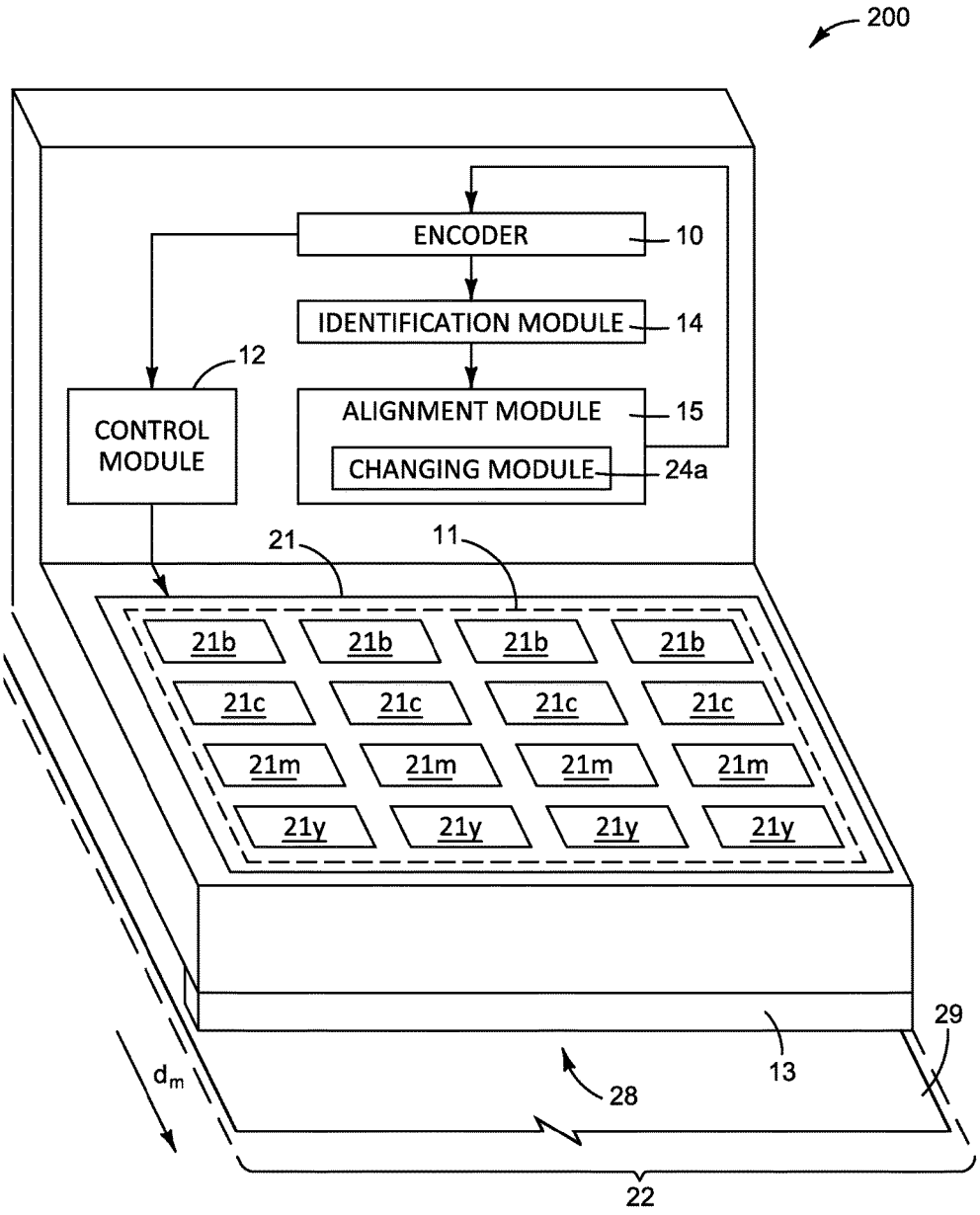
FIGS. 2 and 3 are schematic views illustrating a printing system according to examples.
Figure 3:
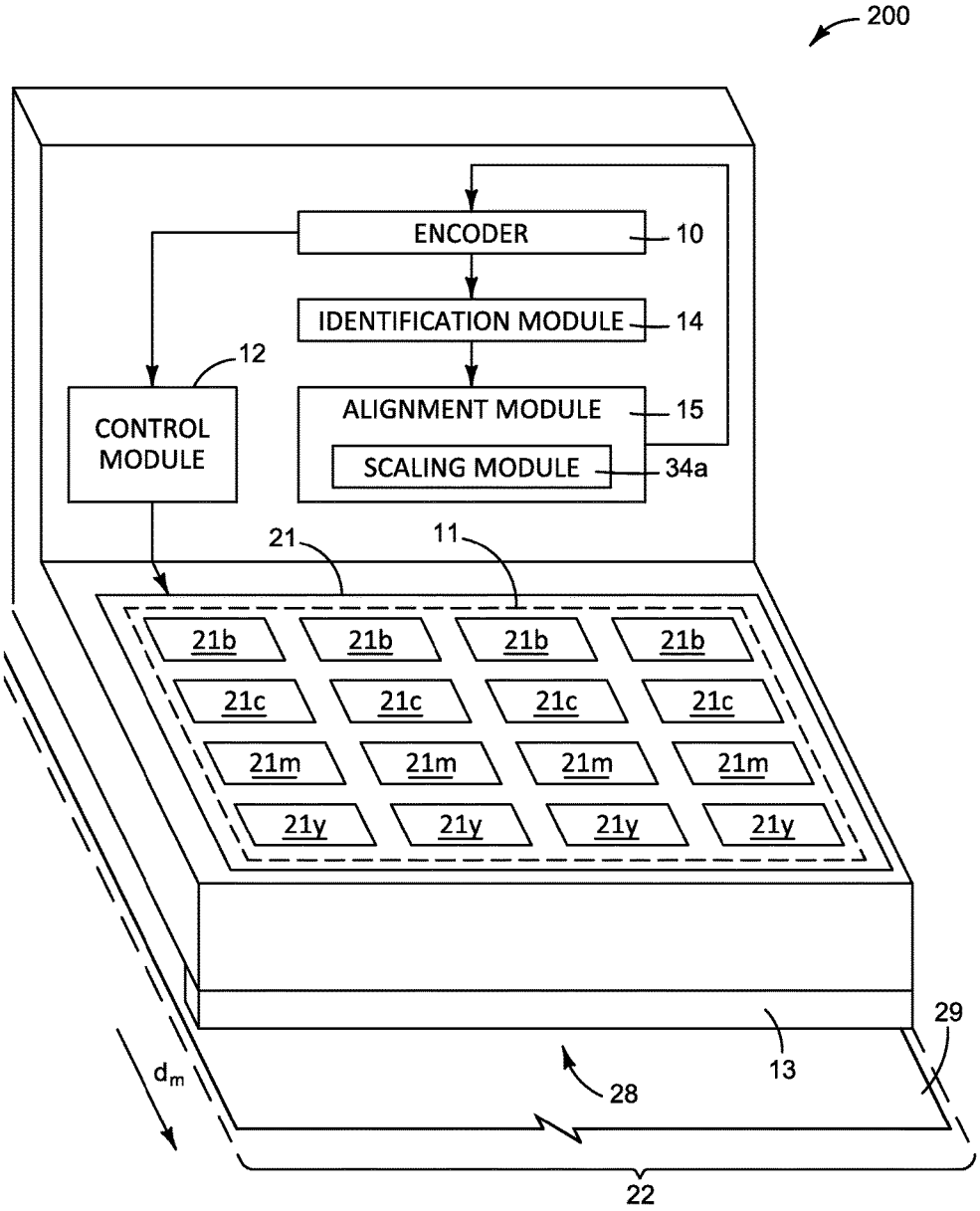
Figure 4:
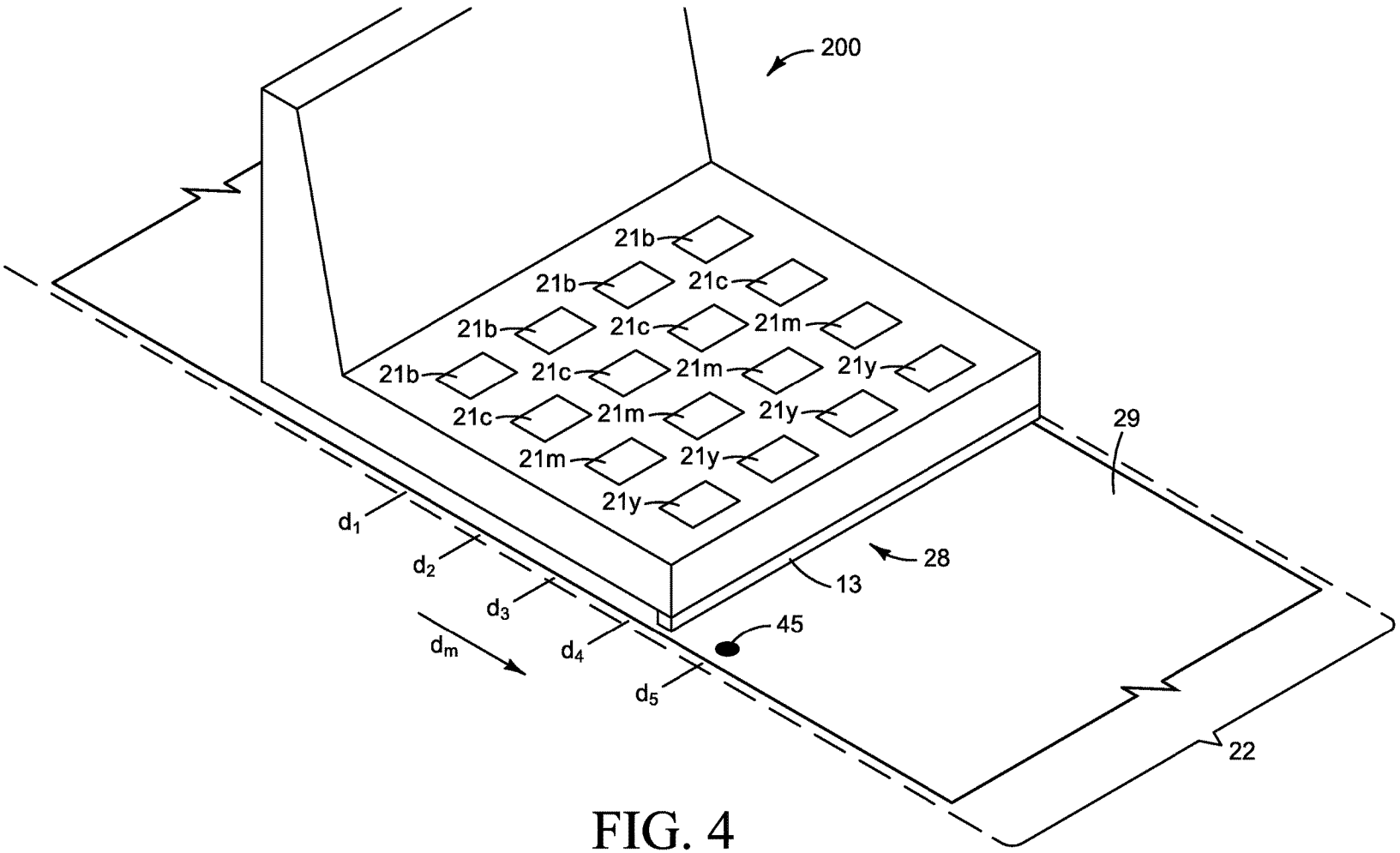
FIG. 4 is a schematic view illustrating a media and a portion of the printing system of FIGS. 2 and 3 according to an example.

FIGS. 2 and 3 are schematic views illustrating a printing system according to examples. FIG. 4 is a schematic view illustrating a media and a portion of the printing system of FIGS. 2 and 3 according to an example. In some examples, the printing system 200 may include the encoder 10, the printhead receiving area 11, the control module 12, the detector 13, the identification module 14, and the alignment module 15 previously discussed with respect to the printing system 100 of FIG. 1. In some examples, the printing system 200 may include a plurality of printheads 21 (21*b*, 21*c*, 21*m*, and 21*y*) disposed in a printhead receiving area 11. The printheads 21 may be stationary and spaced apart from each other. In some examples, the printheads 21 may be removable printheads. The printhead receiving area 11 may include respective compartments and/or respective surfaces to receive the respective printheads 21.

Referring to FIGS. 2-4, in some examples, the printheads 21 may correspond to black printing fluid printheads 21*b*, cyan printing fluid printheads 21*c*, magenta printing fluid printheads 21*m*, and yellow printing fluid printheads 21*y*. For example, a respective black printing fluid printhead 21*b* may be disposed upstream in a media transport direction $d_m$ from a respective cyan printing fluid printhead 21*c* which may be disposed upstream from a respective magenta printing fluid printhead 21*m* which may be disposed upstream from a respective yellow printing fluid printhead 21*y*.

Referring to FIGS. 2-4, in some examples, the encoder 10 generates encoder pulses at a rate corresponding to a speed of a media. The encoder pulses are intended to correspond to a respective position of the media 29 along a media path 22 with respect to the each one of the printheads 21. That is, each encoder pulse represents a fixed media distance. The correspondence between the respective encoder pulses and movement of the media the encoder 10 enables synchronization of drop ejection from the printheads 21 with respect to the media position. A specific number of encoder pulses generated by the encoder 10 corresponds to specific position of the media 29 with respect to each one of the printheads 21.

For example, the media 29 may move along a media path 22 in a media transport direction $d_m$ through the print zone 28. The media 29 (e.g., respective portion thereof) may proceed to opposite the printheads 21 in a sequential manner in which the media 29 may first arrive opposite the black printing fluid printhead 21. Secondly, the media 29 may arrive opposite the cyan printing fluid printhead 21*c*. Thirdly, the media 29 may arrive opposite the magenta printing fluid printhead 21*m*. Fourthly, the media 29 may arrive opposite the yellow printing fluid printhead 21*y*. Thus, first the black printing fluid may be printed first and, subsequently, followed by cyan printing fluid, magenta printing fluid, and, lastly the yellow printing fluid.

That is, at position $d_1$, a respective portion of the media 29 may be positioned to receive respective ink drops from a respective black printing fluid printhead 21*b*. Also, at position $d_2$, a respective portion of the media 29 may be positioned to receive respective ink drops from a respective cyan printing fluid printhead 21*c*. Further, at position $d_3$, a respective portion of the media 29 may be positioned to receive respective ink drops from a respective magenta printing fluid printhead 21*m*. Lastly, at position $d_4$, a respective portion of the media 29 may be positioned to receive respective ink drops from a respective yellow printing fluid printhead 21*y*.

Referring to FIGS. 2-4, in some examples, the timing of each printhead 21 may be controlled by utilizing an encoder pulse generated by the encoder 10 corresponding to the media movement such that each encoder pulse represents a fixed media distance. The control module 12 may selectively control the respective printheads 21 to print an image on the media 29 based on a number of encoder pulses generated by the encoder 10. For example, the control module 12 may communicate with the encoder 10 and the respective printheads 21. In some examples, the control module 12 controls a timing in which to the respective printheads 21 print on the media. For purposes of illustration with reference to the previously discussed arrangement of printheads 21, in a scenario where 5 inches exist between the black printing fluid printheads 21*b* and the cyan printing fluid printheads 21*c*, a location of the cyan printing fluid printheads 21*c* correspond to 3000 encoder pulses away from black printing fluid printheads 21*b* with the encoder resolution at 600 pulses per inch.

Thus if the printing system is intended to print black and cyan ink drops at a same location, then the cyan printing fluid printheads 21*c* may eject respective ink drops 3000 encoder pulses after the black printing fluid printheads 21*b* eject respective ink drops. For example, the generation of 3000 encoder pulses by the encoder corresponds to a distance between the $d_1$ and $d_2$ positions. Accordingly, the printing system 200 may have good printhead to printhead alignment based on the ejection timing of the respective printheads 21. Alternatively, with the printhead ejection timing off, alignment artifacts such as shadowing, bolding, and the like, may be noticeable in the printed output on the media 29.

Referring to FIGS. 2-4, at least one printhead 21 may print an alignment mark 45 on the media 29. In some examples, the alignment mark 45 may be printed on a particular region of the media 29 such as in a media margin and/or have a particular shape. In some examples, the detector 13 detects the alignment mark 45 on the media 29 in a print zone 28. The detector 13 may include an optical sensor, and the like. The identification module 14 identifies a number of the encoder pulses generated by the encoder 10 during a time interval from printing of the alignment mark 45 by at least one printhead 21 until a detection of the alignment mark 45 by the detector 13. For example, the identification module 14 may communicate with the encoder 10, the detector 13, and the alignment module 15. In some examples, the detector 13 detects the alignment mark 45 on the media 29 in the print zone 28.

Referring to FIG. 2, in some examples, the alignment module 14 may include a changing module 24*a*. The changing module 24*a* may change the number of encoder pulses based on the amount of variation between the number of encoder pulses detected and the number of encoder pulses. For example, in the previously discussed example, the cyan printing fluid printheads 21*c* may be ejected at a number of encoder pulses other than 3000 encoder pulses after the black printing fluid printheads 21*b*.

Referring to FIG. 3, in some examples, the alignment module 14 may include a scaling module 34*a*. For example, the scaling module 34*a* may scale the encoder pulses generated by the encoder 10 based on the amount of variation between the number of encoder pulses detected and the number of encoder pulses to maintain the number of encoder pulses constant. For example, in the previously discussed example, the encoder scale could be changed by generating a different number of pulses per inch other than 600 pulses per inch based on the amount of variation. In some examples, the scaling module 34*a* may use the number of encoder pulses detected between the alignment mark and the detector 13 during a calibration run. During a calibration run, the printing system may print a number of diagnostic patterns that may be inspected either manually or automatically. In addition, a calibration run is useful for determining the number of encoder pulses between subsequent printheads. Thus, the alignment module 14 may be a closed loop system that may automatically compensate for the alignment variation throughout a print run based on static conditions such as an incorrect spacing between printheads 21 and dynamic misalignment conditions such as media moisture content, and the like.

In some examples, the encoder 10, the control module 12, the detector 13, the identification module 14, the alignment module 15, the changing module 24*a* and/or the scaling module 34*a* may be implemented in hardware, software including firmware, or combinations thereof. The firmware, for example, may be stored in memory and executed by a suitable instruction-execution system. If implemented in hardware, as in an alternative example, the encoder 10, the control module 12, the detector 13, the identification module 14, the alignment module 15, the changing module 24*a*, and/or the scaling module 34*a* may be implemented with a combination of technologies (for example, discrete-logic circuits, application-specific integrated circuits (ASICs), programmable-gate arrays (PGAs), field-programmable gate arrays (FPGAs)), and/or other later developed technologies. In other examples, the encoder 10, the control module 12, the detector 13, the identification module 14, the alignment module 15, the changing module 24*a*, and/or the scaling module 34*a* may be implemented in a combination of software and data executed and stored under the control of a computing device.

Figure 5:
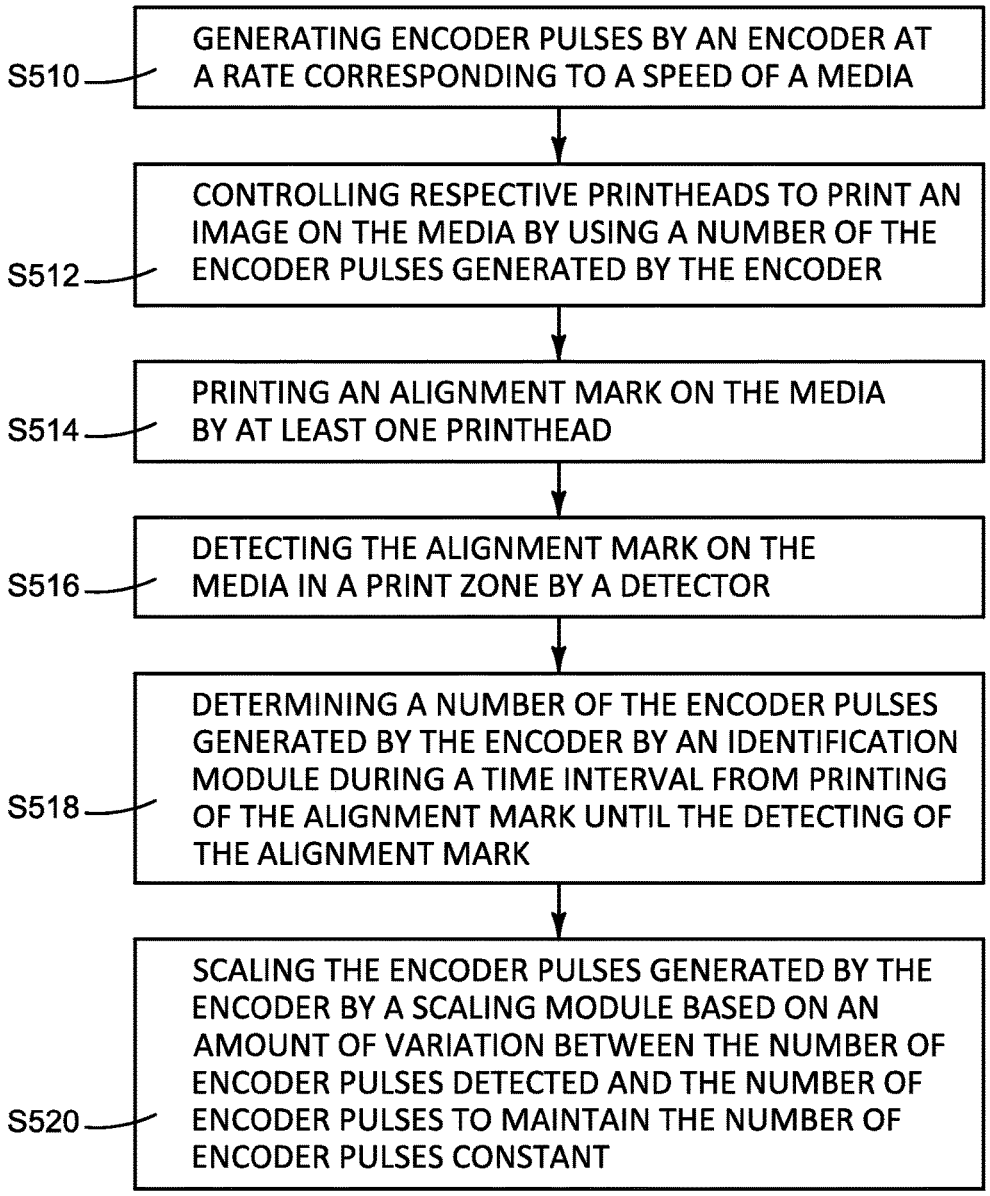
FIG. 5 is a flowchart illustrating a method of aligning printing from a plurality of printheads according to an example.

FIG. 5 is a flowchart illustrating a method of aligning printing from a plurality of printheads according to an example. In some examples, the modules, assemblies, and the like, previously discussed with respect to FIGS.1-4 may be used to implement the method of FIG. 5. In block S510, encoder pulses are generated by an encoder at a rate corresponding to a speed of a media. That is, each encoder pulse represents a fixed media distance. The correspondence between the respective encoder pulses and movement of the media the encoder enables synchronization of drop ejection from the printheads with respect to the media position. In some examples, encoder pulses equally spaced apart from each other are generated by an encoder over a predetermined period of time. In block S512, the respective printheads are controlled to print an image on a media by using a number of the encoder pulses.

For example, a timing of activation of the respective printheads is controlled to print on the media the image corresponds to image data and the number of encoder pulses generated by the encoder. For example, the number of encoder pulses is used as a reference to position the respective printhead's ink drops at respective positions with respect to the media along a media transport path. In block S514, an alignment mark is printed on the media by at least one printhead. In block S516, the alignment mark on the media is detected in a print zone by a detector. For example, the detector may include an optical sensor. In block S518, a number of the encoder pulses generated by the encoder is identified by an identification module during a time interval from the printing of the alignment mark until the detecting of the alignment mark. For example, a generation of the number of encoder pulses may correspond to the media length from the respective printhead to the detector.

In block S520, the encoder pulses generated by the encoder are scaled by a scaling module based on an amount of variation between the number of encoder pulses detected and the number of encoder pulses to maintain the number of encoder pulses constant. For example, scaling may use the rate the encoder pulses are generated by the encoder and a respective position of a respective printhead with respect to the media along a media transport path. In some examples, the encoder pulses generated by the encoder are scaled by the scaling module while the media to be printed on is in the print zone. Also, in some examples, the number of the encoder pulses generated by the encoder during the time interval may be determined and scaled in real-time. In some examples, the scaling of the encoder pulses generated by the encoder may also include adjusting the rate by the scaling module based on the amount of variation.

Figure 6:
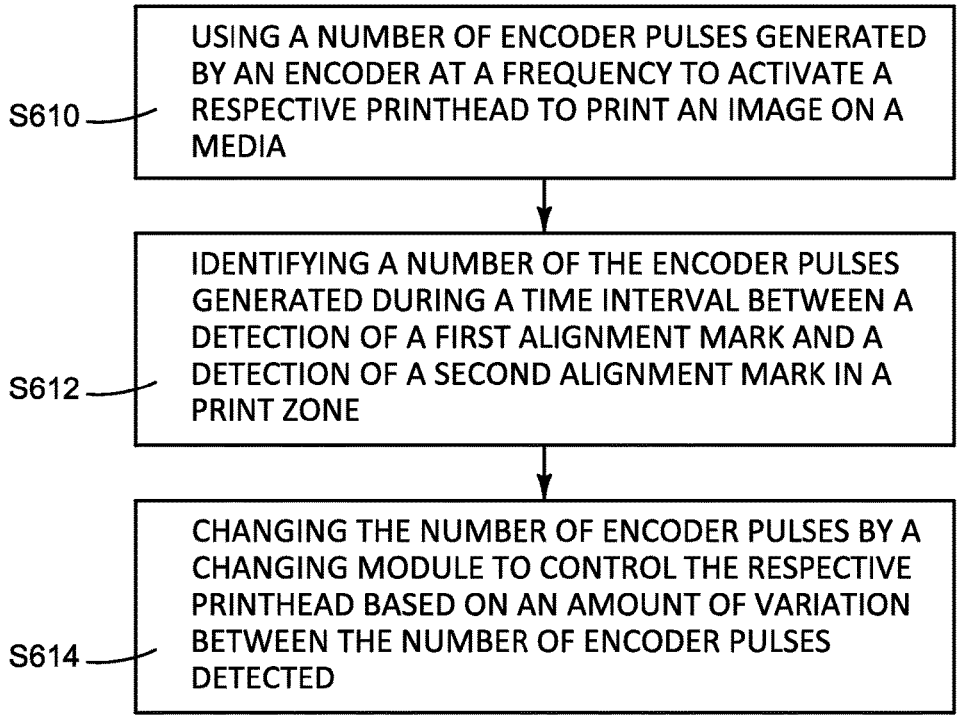
FIG. 6 is a flowchart illustrating a method of aligning printing from a plurality of printheads according to an example.

FIG. 6 is a flowchart illustrating a method of aligning printing from a plurality of printheads according to an example. In some examples, the modules, assemblies, and the like, previously discussed with respect to FIGS.1-4 may be used to implement the method of FIG. 6. In block S610, a number of the encoder pulses generated by the encoder at a rate corresponding to a speed of a media is used to activate a respective printhead to print an image on a media. In block S612, a number of the encoder pulses generated by the encoder are identified by an identification module during a time interval between a detection of a first alignment mark and a detection of a second alignment mark by the detector in the print zone. In some examples, the number of the encoder pulses generated by the encoder during the time interval are identified and scaled in real-time.

In block S614, the number of encoder pulses is changed by a changing module to control the respective printhead based on an amount of variation between the number of encoder pulses detected. For example, the number of encoder pulses is changed while the media to be printed on is in the print zone. In some examples, changing the number of encoder pulses to control the respective printhead based on an amount of variation between the number of encoder pulses detected may also include calculating the amount of variation by the changing module by dividing the number of encoder pulses detected by a number that corresponds to the rate that the encoder pulses are generated by the encoder and a respective position of a respective printhead with respect to the media along a media transport path.

Figure 7:
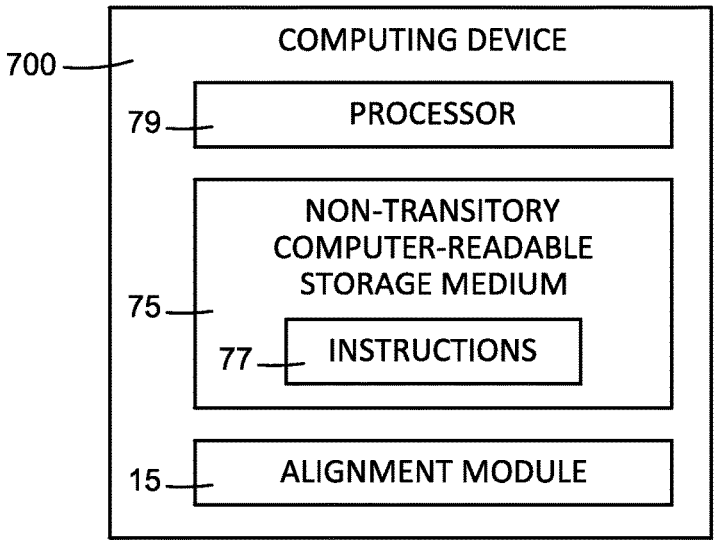
FIG. 7 is a block diagram of a computing device according to an example.

FIG. 7 is a block diagram illustrating a computing device such as a printing system including a processor and a non-transitory, computer-readable storage medium to store instructions to operate the printing system according to an example. Referring to FIG. 7, in some examples, the non-transitory, computer-readable storage medium 75 may be included in a computing device 700 such as the printing system. In some examples, the non-transitory, computer-readable storage medium 75 may be implemented in whole or in part as instructions 77 such as computer-implemented instructions stored in the computing device locally or remotely, for example, in a server or a host computing device considered herein to be part of the printing system.

Referring to FIG. 7, in some examples, the non-transitory, computer-readable storage medium 75 may correspond to a storage device that stores instructions 77, such as computer-implemented instructions and/or programming code, and the like. For example, the non-transitory, computer-readable storage medium 75 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 7, examples of storage devices include, but are not limited to, hard disk drives, compact disc drives, digital versatile disc drives, optical drives, and flash memory devices. In some examples, the non-transitory, computer-readable storage medium 75 may even be paper or another suitable medium upon which the instructions 77 are printed, as the instructions 77 can be electronically captured, via, for instance, optical scanning of the paper or other medium, then compiled, interpreted or otherwise processed in a single manner, if necessary, and then stored therein. A processor 79 generally retrieves and executes the instructions 77 stored in the non-transitory, computer-readable storage medium 75, for example, to operate a computing device 700 such as a printing system including an alignment module 15 in accordance with an example.

For example, the alignment module 15 may at least one of change the number of encoder pulses or scale the encoder pulses generated by the encoder based on an amount of variation between the number of encoder pulses detected and the number of encoder pulses to maintain the number of encoder pulses constant. In an example, the non-transitory, computer-readable storage medium 75 can be accessed by the processor 79.

It is to be understood that the flowcharts of FIGS. 5 and 6 illustrate architecture, functionality, and/or operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 5 and 6 illustrate a specific order of execution, the order of execution may differ from that which is depicted. For example, the order of execution of two or more blocks may be rearranged relative to the order illustrated. Also, two or more blocks illustrated in succession in FIGS. 5 and 6 may be executed concurrently or with partial concurrence. All such variations are within the scope of the present disclosure.

The present disclosure has been described using non-limiting detailed descriptions of examples thereof. Such examples are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may describe examples contemplated by the inventors and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A printing system, comprising:

an encoder to generate encoder pulses at a rate corresponding to a speed of a media;

a printhead receiving area to receive a plurality of printheads, at least one printhead to print an alignment mark on the media;

a control module to selectively control the respective printheads to print an image on the media based on a number of encoder pulses generated by the encoder;

a detector to detect the alignment mark on the media in a print zone;

an identification module to identify a number of the encoder pulses generated by the encoder during a time interval from the printing of the alignment mark until the detecting of the alignment mark; and an alignment module to at least one of change the number of encoder pulses or scale the encoder pulses generated by the encoder based on an amount of variation between the number of encoder pulses detected and the number of encoder pulses to maintain the number of encoder pulses constant.

2. The printing system of claim 1, wherein the alignment module further comprises:

a changing module to change the number of encoder pulses based on the amount of variation between the number of encoder pulses detected and the number of encoder pulses.

3. The printing system of claim 1, wherein the alignment module further comprises:

a scaling module to scale the encoder pulses generated by the encoder based on the amount of variation between the number of encoder pulses detected and the number of encoder pulses to maintain the number of encoder pulses constant.

4. The printing system of claim 3, wherein the control module is to control a timing in which to the respective printheads print on the media.

5. The printing system of claim 1, wherein the detector is disposed in the print zone.

6. A method of aligning printing from a plurality of printheads, the method comprising:

generating encoder pulses by an encoder at a rate corresponding to a speed of a media;

controlling the respective printheads to print an image on the media by using a number of the encoder pulses generated by the encoder;

printing an alignment mark on the media by at least one printhead;

detecting the alignment mark on the media in a print zone by a detector;

determining a number of the encoder pulses generated by the encoder by an identification module during a time interval from the printing of the alignment mark until the detecting of the alignment mark; and scaling the encoder pulses generated by the encoder by a scaling module based on an amount of variation between the number of encoder pulses detected and the number of encoder pulses to maintain the number of encoder pulses constant.

7. The method of claim 6, wherein the controlling the respective printheads to print an image on the media by using a number of the encoder pulses generated by the encoder further comprises:

controlling a timing of activation of the respective printheads to print on the media.

8. The method of claim 6, wherein the scaling uses the rate the encoder pulses are generated by the encoder and a respective position of a respective printhead with respect to the media along a media transport path.

9. The method of claim 7, wherein the scaling of the encoder pulses generated by the encoder further comprises:

adjusting the rate corresponding to the speed of the media by the scaling module based on the amount of variation.

10. The method of claim 6, wherein the encoder pulses generated by the encoder are scaled by the scaling module while the media to be printed on is in the print zone.

11. The method of claim 6, wherein the number of the encoder pulses generated by the encoder during the time interval is identified and scaled in real-time.

12. A non-transitory computer-readable storage medium having computer executable instructions stored thereon to operate a printing system, the instructions are executable by a processor to:

use a number of encoder pulses generated by an encoder at a rate corresponding to a speed of a media to activate a respective printhead to print an image on the media;

identify a number of the encoder pulses generated during a time interval between a detection of a first alignment mark and a detection of a second alignment mark in a print zone; and change the number of encoder pulses by a changing module to control the respective printhead based on an amount of variation between the number of encoder pulses detected.

13. The non-transitory computer-readable storage medium of claim 12, wherein the number of encoder pulses is changed while the media to be printed on is in the print zone.

14. The non-transitory computer-readable storage medium of claim 12, wherein the number of the encoder pulses generated by the encoder during the time interval are identified and scaled in real-time.

15. The non-transitory computer-readable storage medium of claim 12, wherein the respective printhead comprises an inkjet printhead.

* * * * *